United States Patent [19]

Specht et al.

[11] 4,285,793

[45] Aug. 25, 1981

[54] SLIDE-BACK TYPE INTERCELL BUS BAR CONNECTOR

[75] Inventors: Steven J. Specht, Mentor, Ohio; Morton S. Kircher, Clearwater, Fla.

[73] Assignee: Olin Corporation, New Haven, Conn.

[21] Appl. No.: 101,386

[22] Filed: Dec. 7, 1979

[51] Int. Cl.[3] ..... C25B 9/04

[52] U.S. Cl. ..... 204/253; 204/267; 204/279

[58] Field of Search ..... 204/253–258, 204/267–270, 279, 263–266, 228; 429/158, 160

[56] References Cited

U.S. PATENT DOCUMENTS

| | | | |
|---|---|---|---|
| 1,797,374 | 3/1931 | Smith | 204/253 |
| 3,432,422 | 3/1969 | Currey | 204/258 |
| 3,498,903 | 3/1970 | Kamarjan | 204/258 X |
| 3,700,582 | 10/1972 | Giacopelli | 204/266 X |
| 3,783,122 | 1/1974 | Sato et al. | 204/279 |
| 3,859,196 | 1/1975 | Ruthel et al. | 204/279 X |
| 3,930,978 | 1/1976 | Strewe et al. | 204/267 X |
| 4,078,984 | 3/1978 | Strewe | 204/267 X |
| 4,105,529 | 8/1978 | Pohto | 204/279 X |

FOREIGN PATENT DOCUMENTS

| | | | |
|---|---|---|---|
| 2055161 | 5/1971 | Fed. Rep. of Germany | 204/228 |

*Primary Examiner*—Delbert E. Gantz
*Assistant Examiner*—D. R. Valentine
*Attorney, Agent, or Firm*—Ralph D'Alessandro; Thomas P. O'Day

[57] ABSTRACT

An intercell connector system is disclosed. The system includes two adjacent terminals attached to two adjacent cells and intercell connector selectively overlapping the adjacent ends of the terminals. The intercell connector includes a conductive first member and a second member which are held together by a fastening device which can be selectively loosened and tightened. When the fastening device is loosened, the two members are adapted to be moved out of engagement with one of the terminals thereby disconnecting the electrical circuit between the terminals.

30 Claims, 2 Drawing Figures

SLIDE-BACK TYPE INTERCELL BUS BAR CONNECTOR

This invention relates to electrolytic cells and more specifically to intercell connector systems for such cells.

A number of intercell connectors are known to the prior art. One of the most commonly used is the type of intercell connector shown in U.S. Pat. No. 3,432,422, by Currey, issued Mar. 11, 1969 to Hooker Chemical Corporation. That intercell connector includes an L-shaped conductor which is clamped to both the anode bus bar of a first cell and the cathode bus bar of a second cell. The L-shaped conductor is aligned so that the portion clamped to the cathode bus bar is vertical while that portion connected to the anode bus bar of the following cell is horizontal. This method of connection is suitable for cells having relatively low current capacity in comparison to the more recent developed cells which now commonly carry upwards of 150 kiloamperes current. The intercell connector system shown in the Currey patent is not suitable for larger cells because the disconnection of the L-shaped conductor must be made between cells and this would be hazardous without some apparatus not shown in the Currey patent if the cells of the Currey patent are modified so as to carry larger amounts of current. In particular, the cell disclosed in Currey would have to be modified by the addition of either more terminals, much thicker terminals, or some other modification in order to carry currents much over 40 kiloamperes. Furthermore, the L-shaped conductor disclosed in Currey must be completely removed in order to disconnect the cells from one another and this would prove very difficult with the size of L-shaped conductor which would be necessary for larger cells. Furthermore, the space between the cells in the Currey patent is so restricted that if more than two sets of terminals are provided, it would be extremely difficult to manipulate any sort of wrench between the cells.

The problem of redesigning the cell disclosed in the Currey patent to handle larger capacity has led one manufacturer to develop the cell disclosed in U.S. Pat. No. 3,859,196, by Ruthel et al which issued Jan. 7, 1975, to Hooker Chemical & Plastics Corp. The cell of Ruthel includes extensions to both the anode terminal and cathode terminal to bring the terminals out into an aisle adjacent the cell so that the cell can be electrically by-passed by means of a jumper device located in the aisle. This has necessarily resulted in a rather complex structure and lots of extra expensive conductive material for the sole purpose of "jumping" the cell. This extension is termed by Ruthel as "lead-in bus bar" and "anode plate", respectively. This extra copper is an obvious expense of the cell design of Ruthel and there is a need in the art for a cell design which eliminates this extra copper or other conductive material and which, still is able to handle high current capacity cells.

The present invention solves the above problems by providing an intercell connector system for electrically connecting two adjacent electrolytic cells together in electrical series, which connector comprises:

a cathode terminal attached electrically to and projecting from a first of said two cells and an anode terminal attached electrically to and projecting toward said cathode terminal from a second of said two cells, at least one of said anode and cathode terminals having outer portions defining multiple lateral recesses therein;

a conductive first member of sufficient width to simultaneously overlap an outer end of each of said cathode and anode terminals;

a second member of sufficient width to simultaneously overlap an outer end of each of said cathode and anode terminals;

a plurality of fastener means, continuously connecting said first and second plates and aligned laterally with said recesses, for selectively pressing said first and second members together into tight electrical contact with said terminals whereby current flows through said conductive member, and when said fastener means is not being pressed into tight electrical contact with said terminals and said fastener means, for moving into said recesses of said one terminal to thereby disengage said conductive first member from the other terminal.

The invention can also provide for contact areas of at least about 2 square inches per kiloampere of total cell current or more preferably from about three to about five square inches per kiloampere of total cell current. The clamping source provided by the fastening means of the invention is preferably at least about 1,000 pounds per square inch of contact area and more preferably is a pressure in the range from about 2,500 to about 3,500 pounds per square inch of contact area. The intercell connector itself is preferably a pair of parallel conductive plates held together by a bolt which is held captive in one of the plates and which is selectively tightened into a threaded sleeve within the other of the plates. More preferably, the bolt is held captive in both of the plates so that the plates can only be loosened with respect to each other but not fully separated. In such a loosened condition, the plates will then preferably be slid into recesses in one of the terminals.

The invention will be better understood by referring to the attached drawing in which.

Figure 1:
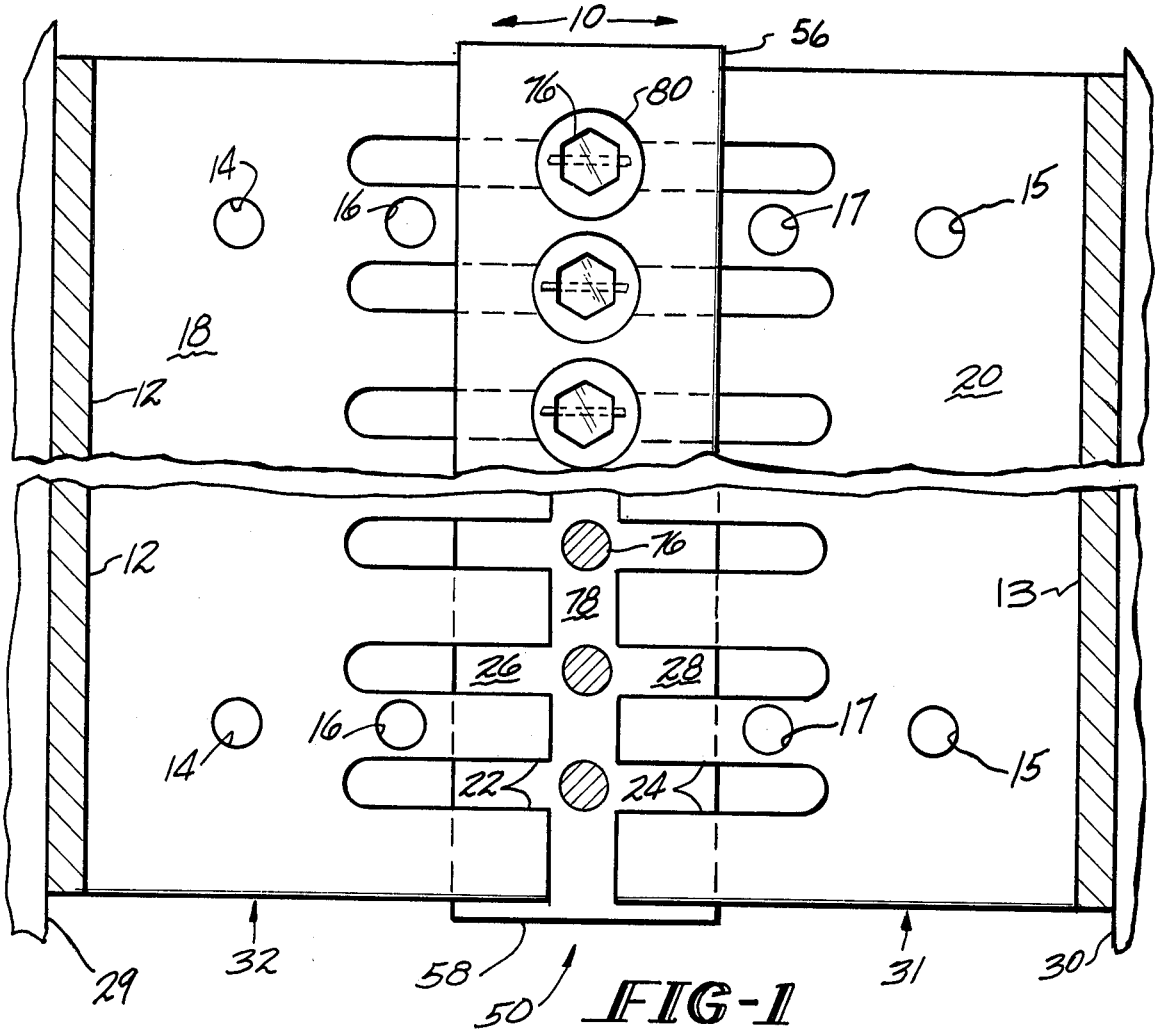
FIG. 1 is a top view, partially in section and partially from above showing a preferred intercell connection system of the invention.

FIG. 1 shows an intercell connector system 10 for electrically connecting two adjacent electrolytic cells 29 and 30 together in electrical series. The system 10 comprises a cathode terminal 32, an anode terminal 31, and an intercell connector 50. Intercell connector 50 overlaps the adjacent outer ends of terminals 31 and 32 to complete an electrical circuit therebetween. The electrical circuit between the left cell 29 and the right cell 30 is from cathodes within the left cell 29 to a collector 12 and from collector 12 through cathode terminal 32, intercell connector 50, anode terminal 31, to a current distributor 13 and then from distributor 13 to the anodes of the right cell 30. Intercell connector 50 can be selectively moved either to the right or left to interrupt this electrical circuit. Cathode terminal 32 comprises a horizontal conductive plate projecting from the left cell 29 toward the right cell 30 while anode terminal 31 comprises a horizontal conductive plate projecting from the right cell 30 toward the left cell 29. Terminals 31 and 32 are preferably coplanar but spaced some distance apart by a gap 78 therebetween. Cathode terminal 32 includes tabs 22 and recesses 26 in its outer portion, the end closest to anode terminal 31 while anode terminal 31 includes tabs 24 and recesses 28 in its outer portion, the end of anode terminal 31 closest to cathode terminal 32. Tabs 22 and 24 and recesses 26 and 28 are preferably aligned so that intercell connector 50 can move to the right or left in the manner described below. Either one of, but not both of, recesses 26 or 28 could be deleted if connector 50 is always to be moved in the same direction for disengagement. Cathode terminal 32 and anode terminal 31 each include portions defining two pairs of pin locating means such as a pair of stop holes 14,15 and a pair of lock holes 16 and 17. Stop holes 14 and 15 are located at a position closer to cells 29 and 30 than are lock holes 16 and 17. Stop holes 14 and 15 and lock holes 16 and 17 serve to receive stop pins 72 (see FIG. 2). When stop pin 72 is located in lock holes 16 or 17, intercell connector 50 cannot move past holes 16 or 17. Similarly, when stop pins 74 are placed in stop holes 14 or 15, intercell connector 50 is prevented from moving past that stop hole 14 or 15. If pins 72 are in all lock holes 16 and 17, connector 50 is locked in its engaged position overlaping both terminals 31 and 32. If, for example, it was desired to move intercell connector 50 from the position shown in FIG. 1 toward the right cell 30, a pair of stop pins 74 would be located in the pair of right stop holes 15 in anode terminal 31 and no pins 72 would be located in the pair of lock holes 17 in anode terminal 31. Intercell connector 50 would then be moved toward the right past right lock holes 17 and against the stop pin 74 now located in right stop holes 15. When intercell connector 50 hits the pair of right stop pins 74 in holes 15 its rightward movement will be stopped. This procedure could equally apply with regard to any movement of intercell connector 50 toward the left cell 29. A similar pair of stop pins 72 could be placed in the pair of left stop pin holes 14 of cathode terminal 32 to prevent intercell connector 50 from moving to the left past stop holes 14. Stop holes 14 and 15 are located far enough back on terminals 31 and 32 from gap 78 to allow intercell connector 50 to move fully onto either anode terminal 31 or cathode terminal 32 when intercell connector 50 is moved to the right or left, respectively.

Figure 2:
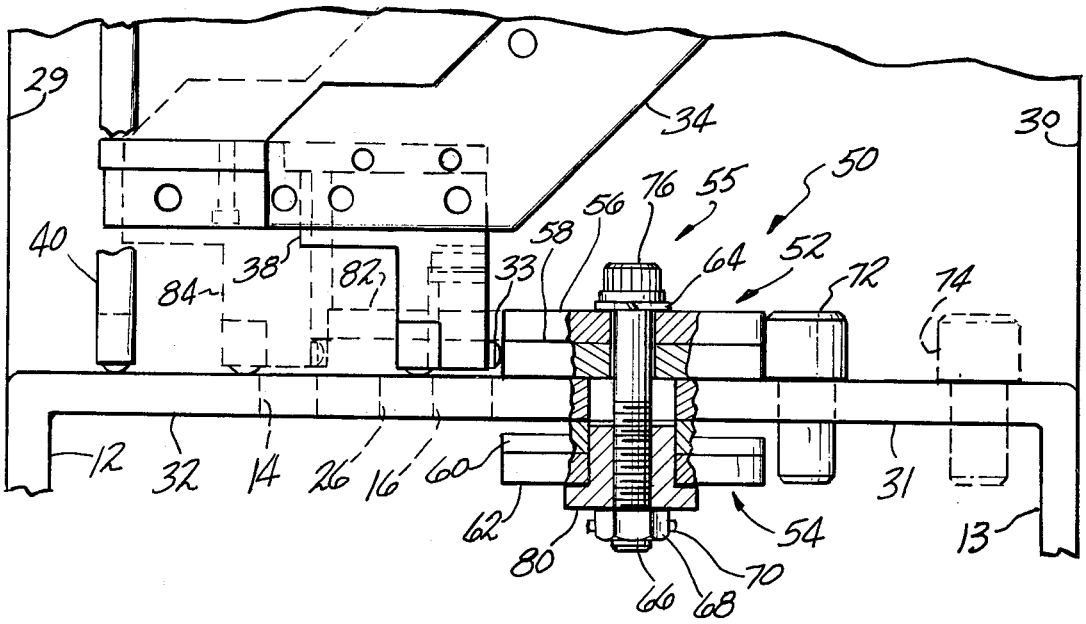
FIG. 2 is a side-elevational view, partly in section showing the intercell connection system of FIG. 1 and also showing the lower portion of an intercell connector bar jack which can be remotely operated to move the intercell connector of the system.

Intercell connector 50 (best seen in FIG. 2) comprises an upper conductive portion 52, a lower conductive portion 54, and a fastening means 55. Upper portion 52 comprises a pair of parallel plates 56 and 58. Lower portion 54 comprises a pair of plates 60 and 62. Fastening means 55 comprises a washer 64, a captive bole 76, a retaining nut 68, a retaining nut pin 70, and a threaded sleeve 80. Plates 58 and 60 are conductive such as, for example, copper plates. Plates 56 and 62 are steel back-up plates serving to give added strength to portions 52 and 54. Bolt 76 is provided with a threaded end 66 upon which retaining nut 68 is threaded and retaining nut pin 70 is inserted through retaining nut 68 and threaded end 66 so as to hold retaining nut 68 in a fixed position on the lower end of captive bolt 76. Prior to this procedure for attaching retaining nut 68 and pin 70, threaded end 66 is inserted through washer 64, plate 56, plate 58 and into gap 78. Bolt 76 is then further inserted into threaded sleeve 80 until threaded end 66 passes completely through threaded sleeve 80 and out the lower end of threaded sleeve 80. Retaining nut 68 is then placed on the portion of threaded end 66 which projects below threaded sleeve 80. Threaded sleeve 80 is held within an opening in lower plates 60 and 62 so that plates 60 and 62 are coupled to upper plates 56 and 58 by bolt 76 and threaded sleeve 80. Bolt 76 cannot move out of threaded sleeve 80 because retaining nut 68 cannot move upwardly past threaded sleeve 80 as would be required to allow bolt 76 to disengage from threaded sleeve 80. However, when bolt 76 is fully loosened, (as shown in FIG. 2) upper portion 52 and lower portion 54 are able to move about sufficiently to allow upper portion 52 to slide along the top side of terminal 31 or terminal 32, because lower portion 54 is moved out of contact with the bottom sides of terminal 31 or terminal 32. When bolt 76 is tightened into threaded sleeve 80, such movement is prevented. Bolts 76 of cell connector 50 (see FIG. 1) are aligned within gap 78 adjacent recesses 26 and 28 so that bolt 76 can move to the left into recesses 26 or to the right into recesses 28 when bolt 76 is loosened.

In order to better show the location of intercell connector 50 when moved to a position in which terminals 31 and 32 are no longer connected by connector 50, the left position of intercell connector 50 is shown by phantom lines 82 of FIG. 2. In order to move connector 50 from this left position, shown by phantom lines 82, back to the position shown in solid lines in FIG. 2, it is preferred to use a remote-controlled intercell connector jack 34 having a contactor means 33. Contactor means 33 is placed in a retracted position (phantom lines 84) against the left hand side of plate 58 of intercell connector 50 when intercell connector 50 is in the left position shown by lines 82. Contactor 33 is then moved by expansion of jack 34 from this retracted position (shown in phantom by lines 84) to the position shown in solid lines in FIG. 2. Jack 34 is the subject of a copending, commonly invented, commonly assigned application. In such application, the operation of jack 34 is fully and completely described. In essence, as respects the present invention, jack 34 expands so as to move contactor 33 away from a support leg 40. Support leg 40 is attached to a second contactor (not shown) which rests against the right wall of left cell 29 so as to prevent support leg 40 from moving to the left when jack 34 is expanding. Instead, when jack 34 is expanded, contactor 33 moves to the right and shoves intercell connector 50 to the right. The final location of intercell connector 50 is determined by the location of stop pins 72 and 74. If stop pins 72 are located in the lock holes 17 of anode terminal 31, rightward movement of intercell connector 50 will stop when intercell connector 50 assumes the position shown in solid lines in FIG. 2. If stop pins 72 are not in holes 17 and stop pins 74 are in stop holes 15 connector 50 will stop against pins 74.

Plate 56 and 62 serve as back-up plates and are preferably made of steel or other non-flexible strong metal while plates 58 and 60 are conductive plates and therefore are preferably bars of some highly conductive flexible metal such as copper. It will be understood that upper portion 52 of intercell connector 50 could be a single conductive plate. Similarly, lower portion 54 could be a single conductive plate. In fact, only one of portions 52 and 54 need be conductive. However, if only one of portions 52 and 54 is conductive, the one portion which is conductive will have to be more substantial than it would be if the other portion was conductive.

The particular number of bolts 76, washers 64, threaded sleeves 80, and pins 70, is preferably selected so as to result in a contact pressure between plates 58, 60, and terminals 31, 32 of greater than about 1,000 pounds per square inch of contact area therebetween and preferably a contact pressure within the range of from about 2,500 to about 3,500 pounds per square inch.

The size of plates 58 and 60 is preferably sufficient to yield a contact area between plates 58, 60 and terminals 31, 32 of greater than 2 square inches per kiloampere of total current. "Total cell current" as used herein means the total current flow between left cell 29 and right cell 30 through the intercell connector system 10. More preferably, the contact area between plates 58, 60, and terminals 31, 32 is greater than 3 square inches per kiloampere of total cell current and most preferably is within the range of from about 3 to about 5 square inches per kiloampere of total cell current. The precise contact pressure and contact area are selected so that plates 58 and 60 are placed against each of terminals 31 and 32 with at least a surface-deforming force. "Surface-deforming force" as used herein means a force sufficient to flatten out a major portion of the surface irregularities, if any, of terminals 31 and 32. It will be understood by those of ordinary skill in the art that deformation of the surface of terminals 31 and 32 in the area of contact when plates 58 and 60 is desirable in order to maximize the conductivity across the surface between intercell connector 50 and terminals 31 and 32.

In order to handle the larger current of the newer high capacity electrolytic cells presently being developed, it is preferred that the cathode terminal 32 projects in a horizontal plane from left cell 29 toward right cell 30 along a width (direction of current flow) within the range of from about 5" (1.27 dm) to about 12" (3 dm) and a length (direction transverse to current flow) within the range of from about 4' (1.23 m) to about 15' (4.7 m) and that anode terminal 31 projects in the horizontal plane, from right cell 30 toward left cell 30 along a width (direction of current flow) within the range of from about 5" (1.27 dm) to about 12" (3 dm) and a length (direction transverse to current flow) within the range of from about 4' (1.23 m) to about 15' (4.7 m) and that intercell connector 50 is oriented along that horizontal plane for conductively contacting terminals 31 and 32 over a length greater than about $\frac{1}{3}$ the length of terminals 31 and 32.

Although only one cathode terminal 32 and one anode terminal 31 are shown in the preferred embodiments, it will be understood that this is done so as to simplify the description of intercell connector system 10 rather than for purposes of limitation to a single anode and cathode terminal. In fact, the most preferred embodiment includes two intercell connection systems 10. That is, intercell connection system 10 would be run parallel to another intercell connection system (not shown) including a second cathode terminal 32 and second anode terminal 31 and a second intercell connector 50 all horizontally aligned in a different horizontal plane than the plane of intercell connection system 10. Another equivalent embodiment which is somewhat less preferred but which is nevertheless within the scope of the invention is an embodiment wherein recesses 26 and 28 extend completely across terminals 31 and 32 thereby dividing terminals 31 and 32 each into multiple tab-like portions 22 and 24. In FIG. 1 tab-like portions 22 and 24 merely extend part way across terminals 32 and 31, respectively, a sufficient distance to enable intercell connector 50 to move completely to the left of or right of gap 78 when it is moved to the left or right respectively. If recesses 26 and 29 extend further, it will be appreciated that intercell connector 50 could be moved further to the right or left, if desired. However, it is more preferred not to fully extend recesses 26 and 28. By only partly extending recesses 26 and 28, a solid cathode plate 18 and a solid anode plate 20 will be provided toward left cell 29 and toward right cell 30 from recesses 26 and 28 respectively. Cathode plate 18 and anode plate 20 can serve as lengthwise current distributor to thereby reduce the amount of metal needed in collector 12 and distributor 13.

Looking again in FIG. 2, it is seen that the electrical flow path from left cell 29 to right cell 30 through intercell connector system 10 is extremely straight and direct and therefore utilizes a minimum of conductive material. This short and direct current flow path therefore results in a major savings in construction expense when building an electrolysis plant comprising a multiplicity of electrolytic cells connected in electrical series. In order to disconnect right cell 30 and left cell 29 it is normally preferred to utilize a jumper system which will contact either cathode plate 18 or anode plate 20 depending on which of cells 29 and 30 is to be removed from the electrical series circuit previously mentioned. It is preferred that a remote-controlled jumper system be utilized to perform that contacting operation so that extra conductive material need not be provided merely for purposes of carrying current lengthwise across terminals 31 and 32 during "jumping" operations. In a copending, commonly invented, commonly assigned application, such a system is disclosed. Basically, as respects the present invention, that system provides a pair of conductor arms which are planted by hydraulic, pneumatic or bolt means to the top and bottom of cathode plate 18 or anode plate 20 as appropriate for jumping one of cells 29 and 30. The arms of such a jumper system are sized so as to have sufficient conductivity and surface area to handle the extremely large currents which pass between cells 29 and 30. The plates 58 and 60 preferably have a thickness within the range of from about 3/16 to about $\frac{3}{4}$". Cathode terminal 32 and anode terminal 31 preferably have a thickness within the range of from about $\frac{3}{8}$" to about $1\frac{1}{2}$". The plates 58 and 60 also preferably have a width within the range of from about $2\frac{1}{2}$" to about 6" and a length within the range of from about 4' to about 15'.

Other embodiments of the invention which relate to the manner of sliding the cell connector system may be employed. For example, the slidable intercell connector may be adapted to slide lengthwise out of engagement with the cathode terminal and the anode terminal. If desired, the intercell connector may be provided with hinges for rotating the intercell connector out of engagement with at least one of the terminals. In order to improve the operation of the intercell connector, at least one backup stiffener plate means forms part of the intercell connector for helping to prevent excessive bending of the terminals or the intercell connector. The cell terminals may be flexible, if desired, but the intercell connector is not flexible.

Although the invention has been primarily described in terms of the best mode currently envisioned, other equivalent embodiments will be apparent to the person of ordinary skill in the art of constructing electrolytic cells and such equivalents are covered in the following claims.

What is claimed is:

1. A cell connector system for electrically connecting and disconnecting a first electrolytic cell adjacent to a second electrolytic cell in series, wherein said system is comprised of:

(a) a cathode terminal attached electrically to said first cell and projecting towards said second cell, (b) an anode terminal attached electrically to said second cell and projecting towards said cathode terminal, (c) each of said terminals having a top side and a bottom side and an outer portion, (d) at least one of said terminals having multiple lateral recesses in said outer portion, (e) a conductive first member overlapping one of said outer sides and said portion of each of said terminals, (f) a second member overlapping the other of said sides and said outer portion of each of said terminals, (g) a plurality of fastener means aligned laterally with said recesses for connecting said first member and said second member, and (1) for pressing said first member and said second member into tight electrical contact with said terminals, whereby current flows between said terminals through said conductive first member, and (2) means for sliding said fastening means into said recesses towards one of said electrolytic cells and for moving said members towards one of said electrolytic cells when said members are not pressed into tight electrical contact with said terminals, thereby disengaging said first conductive member from one of said terminals.

2. The system of claim 1 wherein said cathode terminal and said anode terminal each have recesses in said outer portions to permit said fastener means and said members to be moved towards either of said electrolytic cells when said first member is disengaged from one of said terminals.

3. The system of claim 1 wherein said second member is conductive.

4. The system of claim 1 wherein said first member is highly conductive and said second member is less conductive than said first member.

5. The system of claim 4 wherein said first member is a copper bar and said second member is a steel plate.

6. The system of claim 1 wherein said fastener means comprises a bolt passing through one of said first and second members and into a threaded portion of the other of said first and second members.

7. The system of claim 6 wherein said fastener means further comprises a retainer means attached to said bolt for retaining said bolt in at least one of said members.

8. The system of claim 7 wherein said retainer means is a retaining nut and said threaded portion is a threaded sleeve mounted within said other of said members.

9. The system of claim 1, further comprising at least one stop pin and at least one pin locating means, adapted to be attached to one of said terminals toward which said members are to be moved for stopping the movement of said members at a predetermined location.

10. The system of claim 9 wherein said predetermined location is a location at which said conductive member is disengaged from at least one of said terminals.

11. The system of claim 9 wherein said predetermined location is a location at which said conductive member is engaged with both of said terminals.

12. The system of claim 1 wherein said cathode terminal projects in a horizontal plane along a width within the range of from about 1.27 dm to about 3 dm and a length within the range of from about 1.23 meter to about 4.57 meters; said anode terminal projects in said horizontal plane along a width within the range of from about 1.27 dm to about 3 dm and a length within the range of from about 1.23 meter to about 4.57 meters; and said conductive first member is oriented along said horizontal plane, for conductively contacting said terminals over a length greater than one third the length of said terminals.

13. The system of claim 12 wherein said conductive first member is in said horizontal plane.

14. The system of claim 1 wherein each of said two adjacent cells has at least two of said terminals parallel to each other.

15. The system of claim 14 wherein the total length of said cell terminals fall within the range of from about 1.23 to about 4.57 meters.

16. The system of claim 14 wherein a current of 100 KA–500 KA is passed from said first cell to said second cell through said terminals collectively.

17. The system of claim 16 wherein said first and second cells each have, respectively, from about one to about five of said terminals, vertically spaced.

18. The system of claim 1 wherein said first member is adapted to be slid lengthwise out of engagement with said terminals.

19. The system of claim 1 wherein said first member includes hinges for allowing rotation of said first member out of engagement with at least one of said terminals.

20. The system of claim 1 wherein said first member when pressed into tight electrical contact with said terminals has a contact area greater than two square inches per kiloampere of total cell current.

21. The system of claim 20 wherein said first member is adapted to contact said terminals with at least a surface-deforming force.

22. The system of claim 21 wherein said surface-deforming force is a contact pressure of at least 1,000 psi.

23. The system of claim 22 wherein said first member has a contact area greater than 3 square inches per kiloampere of total cell current.

24. The system of claim 22 wherein said contact area is within the range of from about 3 to about 5 square inches per kiloampere of total cell current.

25. The system of claim 24 wherein said contact pressure is within the range of from about 2,500 to about 3,500 psi of contact area.

26. The system of claim 1 further comprising at least one back-up stiffener plate means forming a part of said first member for helping to prevent excessive bending of said terminals and said first member.

27. The system of claim 26 wherein said terminals are flexible while said first member is not flexible.

28. The system of claim 1 wherein said terminals each have a thickness within the range of from about $\frac{3}{8}''$ to about $1\frac{1}{2}''$.

29. The system of claim 1 wherein said first member and said second member each have a thickness within the range of from about 3/16" to about $\frac{3}{4}''$.

30. The system of claim 1 wherein said first member and said second member each have a width within the range of from about $2\frac{1}{2}''$ to about 6" and a length within the range of from about 4' to about 15'.

* * * * *